US009407002B2

(12) United States Patent
Alexopoulos et al.

(10) Patent No.: US 9,407,002 B2
(45) Date of Patent: Aug. 2, 2016

(54) THREE-DIMENSIONAL MULTIPLE SPIRAL ANTENNA AND APPLICATIONS THEREOF

(71) Applicant: BROADCOM CORPORATION, Irvine, CA (US)

(72) Inventors: Nicolaos G. Alexopoulos, Irvine, CA (US); Seunghwan Yoon, Irvine, CA (US)

(73) Assignee: BROADCOM CORPORATION, Irvine, CA (US)

( * ) Notice: Subject to any disclaimer, the term of this patent is extended or adjusted under 35 U.S.C. 154(b) by 0 days.

(21) Appl. No.: 14/720,441

(22) Filed: May 22, 2015

(65) Prior Publication Data

US 2016/0020508 A1 Jan. 21, 2016

Related U.S. Application Data

(63) Continuation of application No. 13/720,606, filed on Dec. 19, 2012, now Pat. No. 9,041,618, and a continuation-in-part of application No. 13/037,051, filed on Feb. 28, 2011, now Pat. No. 9,270,030, which is a continuation of application No. 13/034,957, filed on Feb. 25, 2011, now Pat. No. 9,190,738.

(60) Provisional application No. 61/614,685, filed on Mar. 23, 2012, provisional application No. 61/731,766, filed on Nov. 30, 2012, provisional application No. 61/322,873, filed on Apr. 11, 2010.

(51) Int. Cl.

| | |
|---|---|
| ***H01Q 1/36*** | (2006.01) |
| ***H01Q 1/38*** | (2006.01) |
| ***H01Q 9/16*** | (2006.01) |
| ***H01Q 9/27*** | (2006.01) |
| ***H01Q 21/20*** | (2006.01) |
| ***H01Q 1/50*** | (2006.01) |

(52) U.S. Cl.

CPC ..... *H01Q 1/362* (2013.01); *H01Q 1/38* (2013.01); *H01Q 1/50* (2013.01); *H01Q 9/16* (2013.01); *H01Q 9/27* (2013.01); *H01Q 21/20* (2013.01)

(58) Field of Classification Search

CPC ..... H01Q 1/36; H01Q 1/362; H01Q 1/38; H01Q 9/16; H01Q 9/27; H01Q 21/20

See application file for complete search history.

(56) References Cited

U.S. PATENT DOCUMENTS 7,646,356 B2 * 1/2010 Adel ..... H01Q 1/273 343/767

8,745,853 B2 * 6/2014 Grbic ..... H01Q 9/27 29/600

* cited by examiner

*Primary Examiner* — Hoang V Nguyen

(74) *Attorney, Agent, or Firm* — Garlick & Markison; Bruce E. Garlick

(57) ABSTRACT

A three-dimensional multiple spiral antenna includes a substrate, a plurality of spiral antenna sections, and a feed point module. The substrate has a three-dimensional shaped region and each spiral antenna section is supported by a corresponding section of the three-dimensional shaped region and conforms to the corresponding section of the three-dimensional shaped region such that, collectively, the spiral antenna sections have an overall shape approximating a three-dimensional shape. The feed point module is coupled to a connection point of at least one of the spiral antenna sections.

20 Claims, 8 Drawing Sheets

12

THREE-DIMENSIONAL MULTIPLE SPIRAL ANTENNA AND APPLICATIONS THEREOF

CROSS REFERENCE TO RELATED PATENTS

The present U.S. Utility patent application claims priority pursuant to 35 U.S.C. §120 as a continuation of U.S. Utility application Ser. No. 13/720,606, entitled "Three-Dimensional Multiple Spiral Antenna and Applications Thereof," filed Dec. 19, 2012, which claims priority pursuant to 35 U.S.C. §119(e) to U.S. Provisional Application No. 61/614,685, entitled "Parabolic Interwoven Assemblies and Applications Thereof," filed Mar. 23, 2012; and U.S. Provisional Application No. 61/731,766, entitled "Three-Dimensional Multiple Spiral Antenna and Applications Thereof," filed Nov. 30, 2012, all of which are hereby incorporated herein by reference in their entirety and made part of the present U.S. Utility patent application for all purposes.

U.S. Utility application Ser. No. 13/720,606 claims priority pursuant to 35 U.S.C. §120 as a continuation-in-part of U.S. Utility application Ser. No. 13/037,051 entitled "RF and NFC RAMM Enhanced Electromagnetic Signaling," filed Feb. 28, 2011, which claims priority pursuant to 35 U.S.C. §120 as a continuation of U.S. Utility application Ser. No. 13/034,957, entitled "Projected Artificial Magnetic Mirror", filed Feb. 25, 2011, which claims priority pursuant to 35 U.S.C. §119(e) to U.S. Provisional Application No. 61/322,873, entitled "Projected Artificial Magnetic Mirror," filed Apr. 11, 2010, all of which are hereby incorporated herein by reference in their entirety and made part of the present U.S. Utility patent application for all purposes.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Technical Field of the Invention

This invention relates generally to wireless communication systems and more particularly to antenna structures used in such wireless communication systems.

2. Description of Related Art

Communication systems are known to support wireless and wire lined communications between wireless and/or wire lined communication devices. Such communication systems range from national and/or international cellular telephone systems to the Internet to point-to-point in-home wireless networks to radio frequency identification (RFID) systems to radio frequency radar systems. Each type of communication system is constructed, and hence operates, in accordance with one or more communication standards. For instance, radio frequency (RF) wireless communication systems may operate in accordance with one or more standards including, but not limited to, RFID, IEEE 802.11, Bluetooth, advanced mobile phone services (AMPS), digital AMPS, global system for mobile communications (GSM), code division multiple access (CDMA), WCDMA, local multi-point distribution systems (LMDS), multi-channel-multi-point distribution systems (MMDS), LTE, WiMAX, and/or variations thereof. As another example, infrared (IR) communication systems may operate in accordance with one or more standards including, but not limited to, IrDA (Infrared Data Association).

For an RF wireless communication device to participate in wireless communications, it includes a built-in radio transceiver (i.e., receiver and transmitter) or is coupled to an associated radio transceiver (e.g., a station for in-home and/or in-building wireless communication networks, RF modem, etc.). The receiver is coupled to the antenna and includes a low noise amplifier, one or more intermediate frequency stages, a filtering stage, and a data recovery stage. The transmitter includes a data modulation stage, one or more intermediate frequency stages, and a power amplifier, which is coupled to the antenna.

Since a wireless communication begins and ends with the antenna, a properly designed antenna structure is an important component of wireless communication devices. As is known, the antenna structure is designed to have a desired impedance (e.g., 50 Ohms) at an operating frequency, a desired bandwidth centered at the desired operating frequency, and a desired length (e.g., ¼ wavelength of the operating frequency for a monopole antenna). As is further known, the antenna structure may include a single monopole or dipole antenna, a diversity antenna structure, an antenna array having the same polarization, an antenna array having different polarization, and/or any number of other electromagnetic properties.

Two-dimensional antennas are known to include a meandering pattern or a micro strip configuration. For efficient antenna operation, the length of an antenna should be ¼ wavelength for a monopole antenna and ½ wavelength for a dipole antenna, where the wavelength ($\lambda$)=c/f, where c is the speed of light and f is frequency. For example, a ¼ wavelength antenna at 900 MHz has a total length of approximately 8.3 centimeters (i.e., $0.25*(3\times10^8$ m/s)/($900\times10^6$ c/s) =0.25*33 cm, where m/s is meters per second and c/s is cycles per second). As another example, a ¼ wavelength antenna at 2400 MHz has a total length of approximately 3.1 cm (i.e., $0.25*(3\times10^8$ m/s)/($2.4\times10^9$ c/s)=0.25*12.5 cm).

While two-dimensional antennas provide reasonably antenna performance for many wireless communication devices, there are issues when the wireless communication devices require full duplex operation and/or multiple input and/or multiple output (e.g., single input multiple output, multiple input multiple output, multiple input single output) operation. For example, for full duplex wireless communications to work reasonably well, received RF signals must be isolated from transmitted RF signals (e.g., >20 dBm). One popular mechanism is to use an isolator. Another popular mechanism is to use duplexers.

BRIEF DESCRIPTION OF THE SEVERAL VIEWS OF THE DRAWING(S)

DETAILED DESCRIPTION OF THE INVENTION

Figure 1:
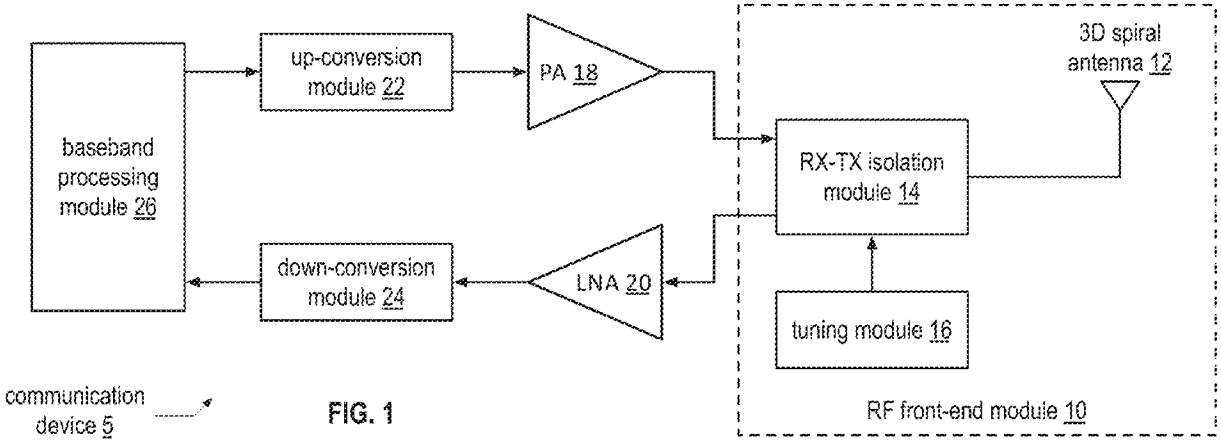
FIG. 1 is a schematic block diagram of an embodiment of a wireless communication device in accordance with the present invention.

FIG. 1 is a schematic block diagram of an embodiment of a wireless communication device 5 that includes a radio frequency (RF) front-end module 10, a power amplifier 18, a low noise amplifier 20, an up-conversion module 22, a down-conversion module 24, and a baseband processing module 26. The RF front-end module 10 includes a three-dimensional (3D) multiple spiral antenna 12, a receive-transmit (RX-TX) isolation module 14, and a tuning module 16.

The communication device 5 may be any device that can be carried by a person, can be at least partially powered by a battery, includes a radio transceiver (e.g., radio frequency (RF) and/or millimeter wave (MMW)) and performs one or more software applications. For example, the communication device 5 may be a cellular telephone, a laptop computer, a personal digital assistant, a video game console, a video game player, a personal entertainment unit, a tablet computer, etc.

In an example of transmitting an outbound RF signal, the baseband processing module 26 converts outbound data (e.g., voice, text, video, graphics, video file, audio file, etc.) into one or more streams of outbound symbols in accordance with a communication standard, or protocol. The up-conversion module 22, which may be a direct conversion module or a super heterodyne conversion module, converts the one or more streams of outbound symbols into one or more up-converted signals. The power amplifier 18 amplifies the one or more up-converted signals to produce one or more outbound RF signals. The RX-TX isolation module 14 isolates the outbound RF signal(s) from inbound RF signal(s) and provides the outbound RF signal(s) to the 3D multiple spiral antenna 12 for transmission. Note that the tuning module 16 tunes the RX-TX isolation module 14.

In an example of receiving one or more inbound RF signals, the 3D antenna 12 receives the inbound RF signal(s) and provides them to the RX-TX isolation module 14. The RX-TX isolation module 14 isolates the inbound RF signal(s) from the outbound RF signal(s) and provides the inbound RF signal(s) to the low noise amplifier 20. The low noise amplifier 20 amplifies the inbound RF signal(s) and the down-conversion module 24, which may be a direct down conversion module or a super heterodyne conversion module, converts the amplified inbound RF signal(s) into one or more streams of inbound symbols. The baseband processing module 26 converts the one or more streams of inbound symbols into inbound data.

The RF front-end module 10 may be implemented as an integrated circuit (IC) that includes one or more IC dies and an IC package substrate. The tuning module 16 is implemented on the one or more IC dies. The IC package substrate supports the IC die(s) and may further include the 3D multiple spiral antenna 12. The RX-TX isolation module 14 may be implemented on the one or more IC dies and/or on the IC package substrate. One or more of the power amplifier 18, the low noise amplifier 20, the up-conversion module 22, the down-conversion module 24, and the baseband processing module 26 may be implemented on the one or more IC dies.

Figure 2:
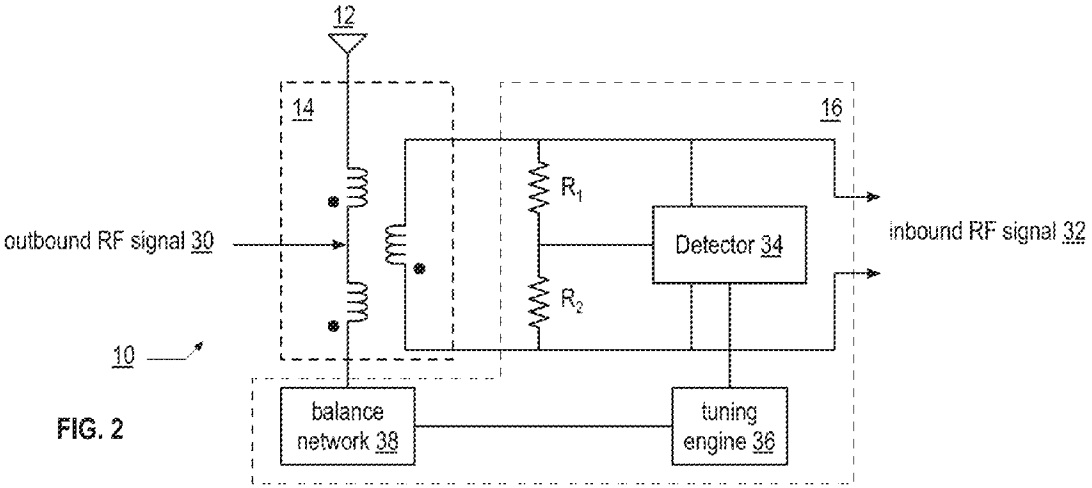
FIG. 2 is a schematic block diagram of an embodiment of an RF front-end module in accordance with the present invention.

FIG. 2 is a schematic block diagram of an embodiment of an RF front-end module 10 that includes the 3D multiple spiral antenna 12, a duplexer 14-1 and a balance network 14-2 as the RX-TX isolation module 14, and a resistor divider (R1 and R2), a detector 34, and a tuning engine 36 as the tuning module 16. The duplexer 14-1 ideally functions, with respect to the secondary winding, to add the voltage induced by the inbound RF signal on the two primary windings and to subtract the voltage induced by the outbound RF signal on the two primary windings such that no outbound RF signal is present on the secondary winding and that two times the inbound RF signal is present on the secondary winding. The balance network 14-2 adjusts its impedance based on feedback from the tuning module 16 to substantially match the impedance of the 3D spiral antenna such that the duplexer functions more closely to ideal.

Figure 3:
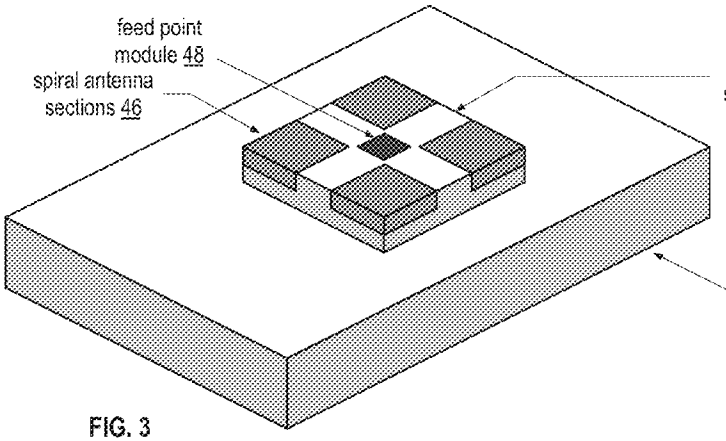
FIG. 3 is an isometric diagram of an embodiment of a three-dimensional multiple spiral antenna in accordance with the present invention.

FIG. 3 is an isometric diagram of an embodiment of a three-dimensional multiple spiral antenna 12 that includes a substrate 40, spiral antenna sections 46, and a feed point module 48 coupled to one or more connection points of the spiral antenna sections 46. The substrate 40, which may be one or more printed circuit boards, one or more integrated circuit package substrates, and/or a non-conductive fabricated antenna backing structure, includes an external three-dimension shaped region 42 (e.g., extends beyond the surface, or a perimeter, of the substrate 40). The spiral antenna sections 46 are supported by and, collectively, conform to the three-dimensional shaped region 42 such that the spiral antenna sections 46 have an overall shape approximating a three-dimensional shape.

For example, when the three-dimensional shaped region 42 has a hyperbolic shape, each spiral antenna section 46 is in a region of the hyperbolic shape and has a shape that corresponds to the respective region. Collectively, the spiral antenna sections 46 have a hyperbolic shape that is about the same size as the three-dimensional shaped region 42. As a further example, the substrate 40 may be a non-conductive antenna backing structure (e.g., plastic, glass, fiberglass, etc.) that is encompassed by the 3D shaped region 42 to provide a hyperbolic shaped antenna. The diameter of the hyperbolic shape may range from micrometers for high frequency (e.g., tens of gigi-hertz) and/or low power applications to tens of meters for lower frequency and/or higher power applications.

As another example, the three-dimensional shaped region 42 has a conical shape and each spiral antenna section 46 is in a region of the conical shape and has a shape that corresponds to the respective region. Collectively, the spiral antenna sections 46 have a conical shape and are about the same size as the three-dimensional shaped region 42. The three-dimensional shaped region 42 may have other shapes, such as a cup shape, a cylindrical shape, a pyramid shape, a box shape (as shown in FIG. 3), a spherical shape, or a parabolic shape.

Figure 4:
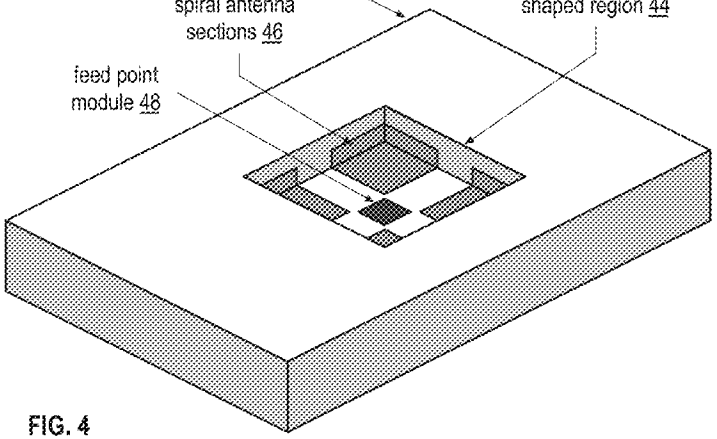
FIG. 4 is an isometric diagram of another embodiment of a three-dimensional multiple spiral antenna in accordance with the present invention.

FIG. 4 is an isometric diagram of another embodiment of a three-dimensional multiple spiral antenna 12 that includes a substrate 40, spiral antenna sections 46, and a feed point module 48 coupled to one or more connection points of the spiral antenna sections 46. The substrate 40, which may be one or more printed circuit boards, one or more integrated circuit package substrates, and/or a non-conductive fabricated antenna backing structure, includes an internal three-dimension shaped region 44 (e.g., extends inward with respect to the surface or outer edge of the substrate 40). Each of the spiral antenna sections 46 is supported by and conforms to a respective region of the three-dimensional shaped region 44 such that, collectively, the spiral antenna sections 46 have an overall shape approximating a three-dimensional shape. The three-dimensional shaped region 44 may have a cup shape, a parabolic shape, a conical shape, a box shape (as shown in FIG. 4), a cylindrical shape, a pyramid shape, or a spherical shape.

Figure 5:
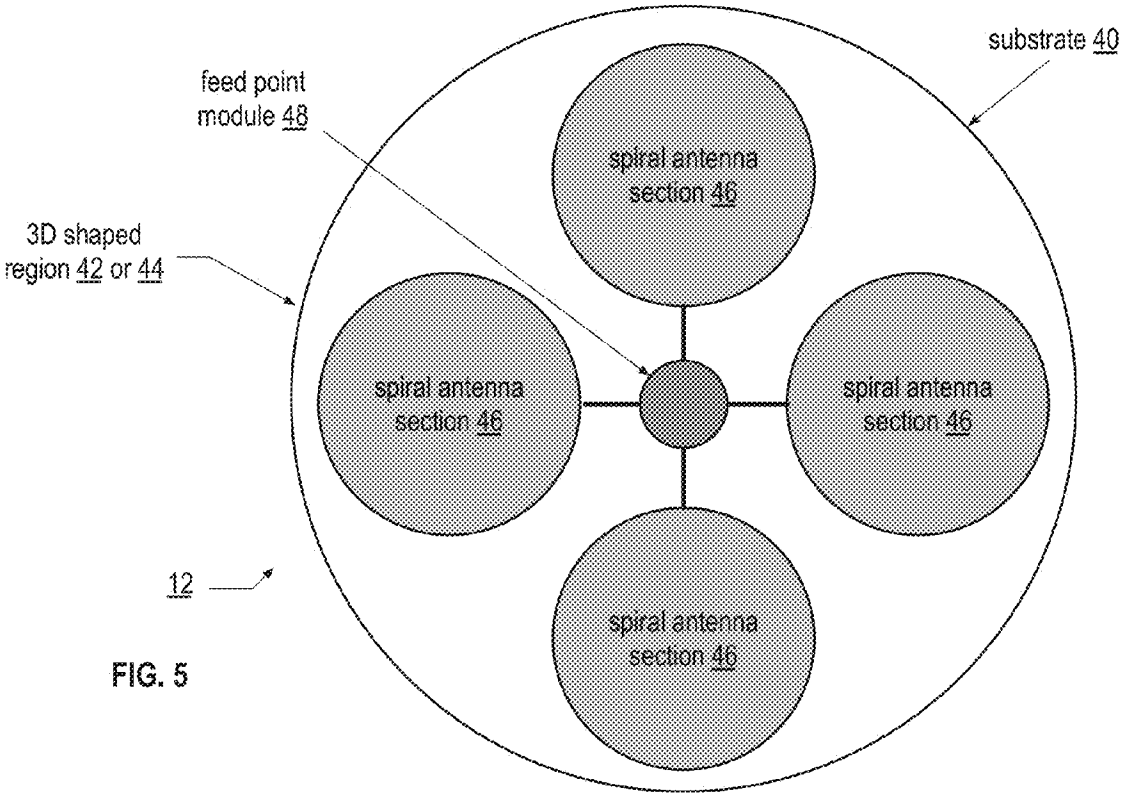
FIG. 5 is a schematic block diagram of an embodiment of a three-dimensional multiple spiral antenna in accordance with the present invention.

FIG. 5 is a schematic block diagram of an embodiment of a three-dimensional multiple spiral antenna 12 that includes four spiral antenna sections 46 coupled to a feed point module 48 on the substrate 40. In this example, the substrate 40 has a parabolic or a hyperbolic shape. Each of the spiral antenna sections 46 is attached (e.g., implemented, affixed, adhered, embedded, encased, etc.) to a region of the substrate and has a shape corresponding to the region of the substrate. For instance, if the substrate 40 is divided into four regions, each a quarter of the hyperbolic or parabolic shape, then each region has a quarter hyperbolic or parabolic shape. Accordingly, each spiral antenna section 46 has a quarter hyperbolic or quarter parabolic shape.

Each of the sections 46 may include one or more spiral antenna elements; examples of which will be discussed in greater detail with reference to one or more of FIGS. 8-13. The feed point module 48 may be implemented in a variety of ways depending on the desired power combining of the 3D multiple spiral antenna 12. For example, if the desired power combining is a parallel power combining, the feed point module 48 includes transmission line connections and a common feed point; an example is further discussed with reference to FIG. 14. As another example, if the desired power combining is a serial power combining, the feed point module 48 includes a phase generator, connections traces, and individual feed points for each of the spiral antenna sections 46; an example is further discussed with reference to FIG. 15.

Figure 14:
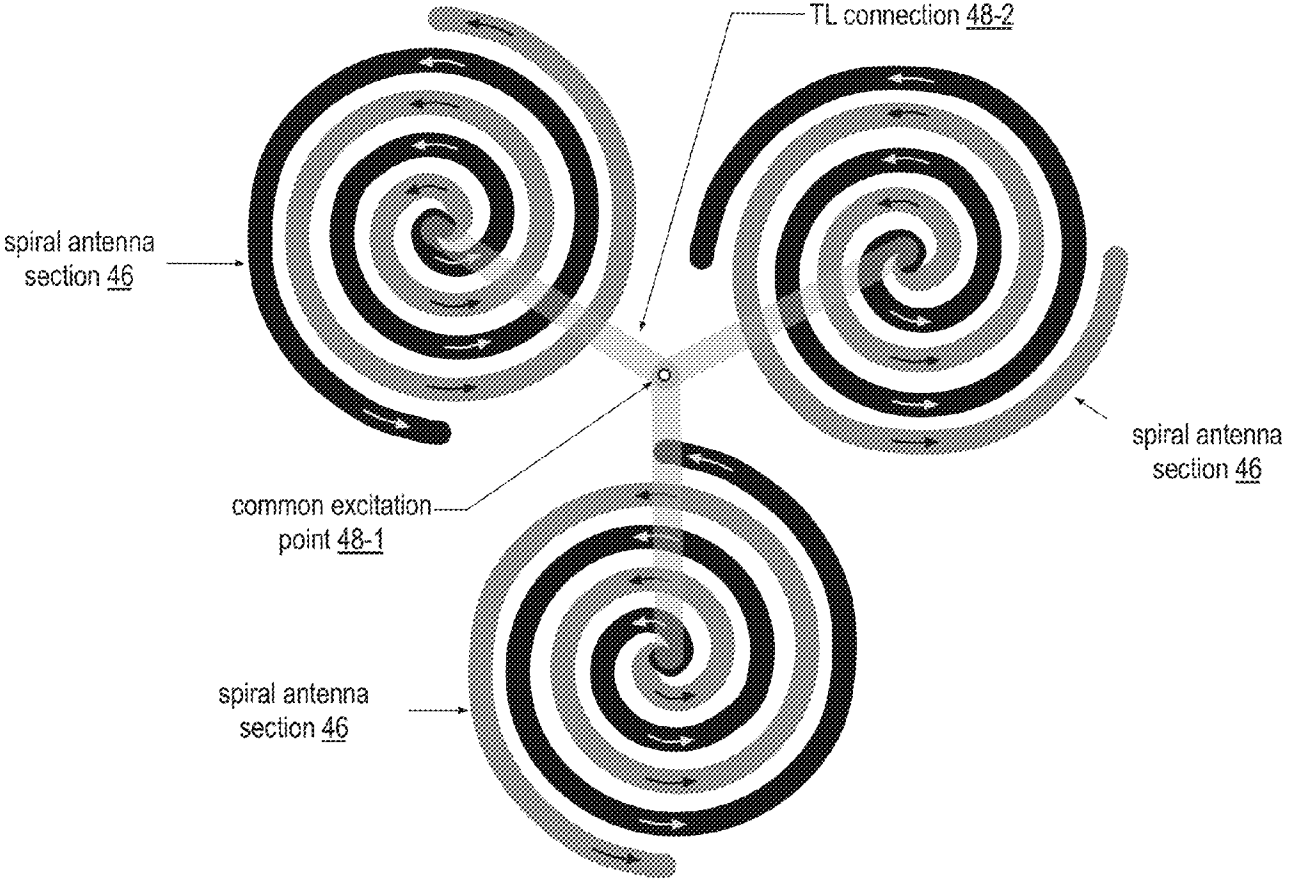
FIG. 14 is a diagram of an embodiment of multiple interwoven spiral antenna elements in accordance with the present invention.
Figure 15:
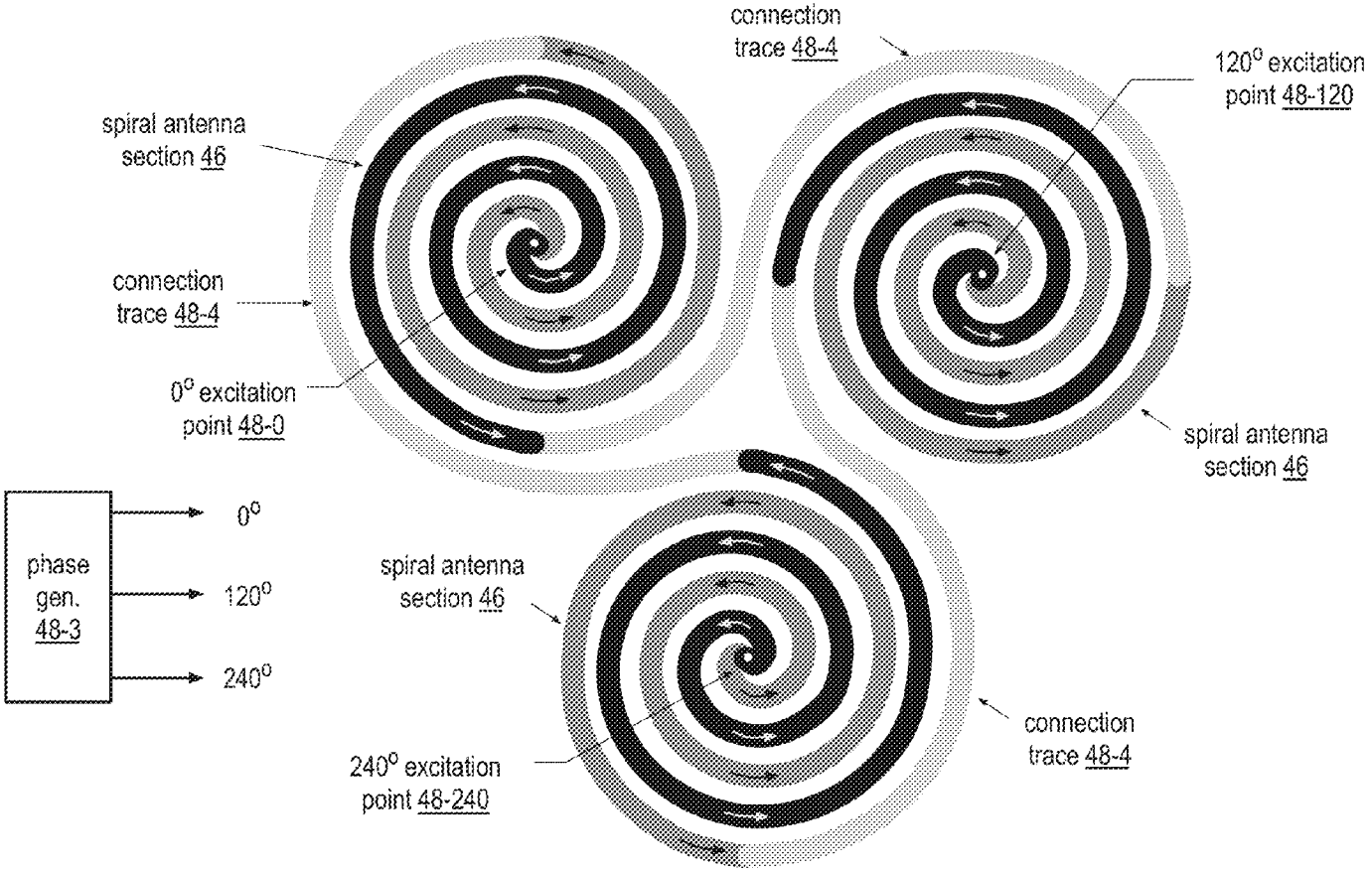
FIG. 15 is a diagram of another embodiment of multiple interwoven spiral antenna elements in accordance with the present invention.

While the present example illustrates four spiral antenna sections 46, the 3D multiple spiral antenna 12 may include more or less than four spiral antenna sections. For instance, and as shown in FIGS. 14 and 15, the 3D multiple spiral antenna 12 includes three spiral antenna sections 46.

Figure 6:
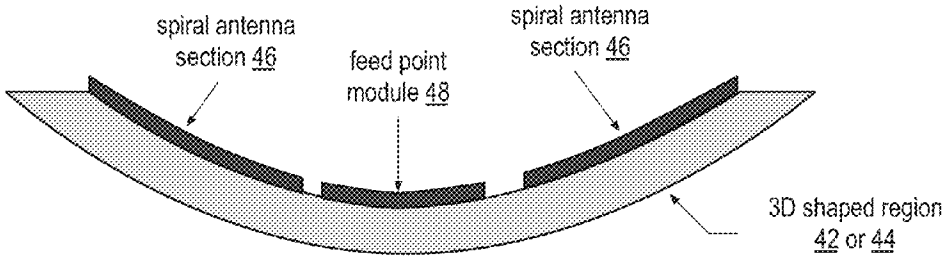
FIG. 6 is a cross sectional view diagram of an embodiment of a three-dimensional multiple spiral antenna in accordance with the present invention.
Figure 7:
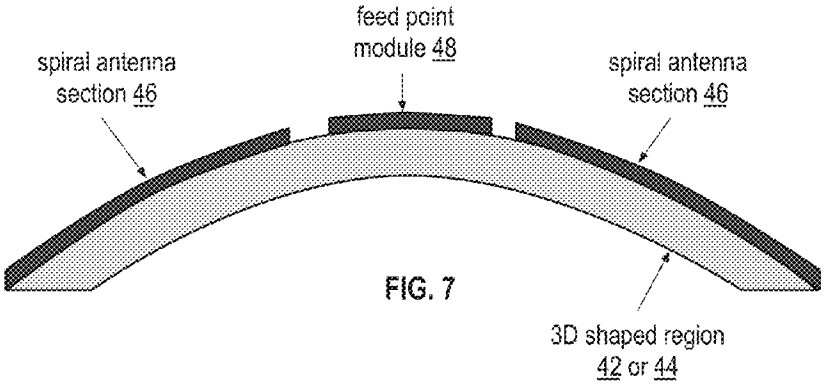
FIG. 7 is a cross sectional view diagram of an embodiment of a three-dimensional multiple spiral antenna in accordance with the present invention.

FIG. 6 is a cross sectional view diagram of an embodiment of the three-dimensional multiple spiral antenna 12 that includes spiral antenna sections 46, the feed point module 48, and a three-dimensional parabolic shaped substrate 40. FIG. 7 is a cross-sectional diagram of the three-dimensional multiple spiral antenna 12 that includes the spiral antenna sections 46, the feed point module 48, and a three-dimensional hyperbolic shaped substrate 40. Note that each of the spiral antenna sections 46 may be implemented in accordance with one or more of FIGS. 8-13.

FIGS. 8-11 are diagrams of embodiments of one of the spiral antenna sections 46 of the 3D multiple spiral antenna 12 that has a one or more turn spiral shape. The spiral shape may be an Archimedean spiral shape and/or an equiangular spiral shape (e.g., Celtic spiral). Due to the spiral nature of the spiral antenna section 46 the antenna has a gain of approximately 3 dB (e.g., a spiral gain component) as a result of the opposite radiation lobe being inverted, which doubles the forward radiation pattern energy. The gain of the antenna 12 is further increased by approximately 2 dB due the three-dimensional shape of the antenna sections 46 (e.g., a three-dimensional gain component). As such, the 3D multiple spiral antenna 12 has approximately a 5 dB gain and combined power from each of the spiral antenna sections 46.

The frequency band of operation of the 3D multiple spiral antenna 12 is based, at least in part, on the physical attributes of the antenna 12. For instance, the dimensions of the excitation region of each of the spiral antenna sections 46 (i.e., the feed point and/or the radius of the inner turn) establish an upper cutoff region of the bandwidth and the circumference of each of the spiral antenna sections 46 establishes a lower cutoff region of the bandwidth. The spiral pattern creates a circular polarization. The trace width, distance between traces, length of each spiral section, distance to a ground plane, and/or use of an artificial magnetic conductor plane affect the quality factor, radiation pattern, impedance (which is fairly constant over the bandwidth), gain, and/or other characteristics of the antenna 12.

Figure 10:
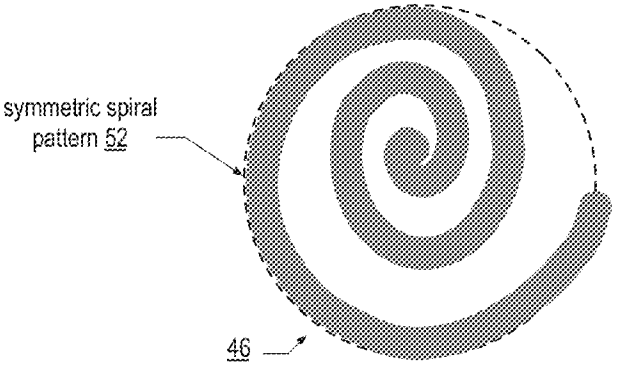
FIG. 10 is a diagram of another embodiment of a spiral antenna element in accordance with the present invention.
Figure 11:
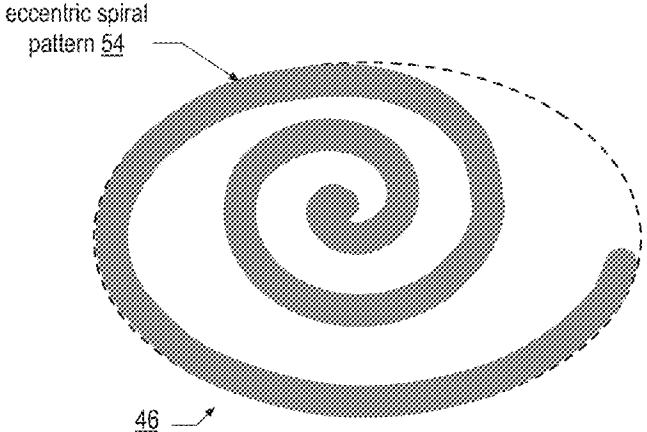
FIG. 11 is a diagram of another embodiment of a spiral antenna element in accordance with the present invention.
Figure 8:
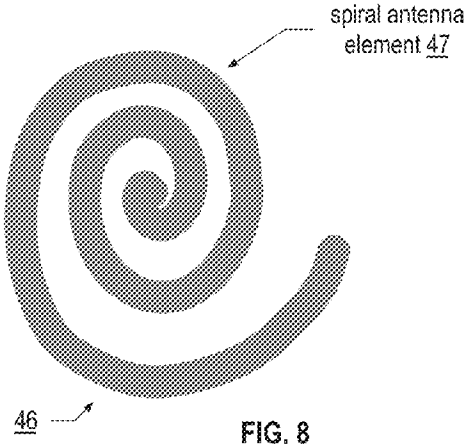
FIG. 8 is a diagram of an embodiment of a spiral antenna element in accordance with the present invention.
Figure 9:
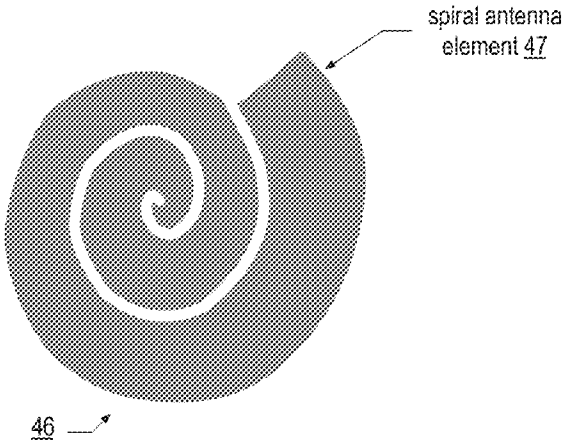
FIG. 9 is a diagram of another embodiment of a spiral antenna element in accordance with the present invention.

As shown in FIG. 8, the spiral antenna section 46 includes a spiral antenna element 47 that has a conductive wire formed as a multiple turn spiral. The length, width, and distance between the turns are dictated by the desired characteristics of the antenna section (e.g., bandwidth, center frequency, quality factor, impedance, polarization, etc.). FIG. 9 illustrates the spiral antenna section 46 including a spiral antenna element 47 that includes a substantially solid conducive material with a multiple turn spiral slot. FIG. 10 illustrates the spiral antenna section 46 including the spiral antenna element 47 with the conductive wire or the substantially solid conductor implementation having a symmetrical spiral pattern 52, which creates a radiation pattern that is substantially perpendicular to the feed point. FIG. 11 illustrates the spiral antenna section 46 including the spiral antenna element 47 with the conductive wire or the substantially solid conductor implementation having an eccentric spiral pattern 54, which creates a radiation pattern that is not perpendicular to the feed point.

Figure 12:
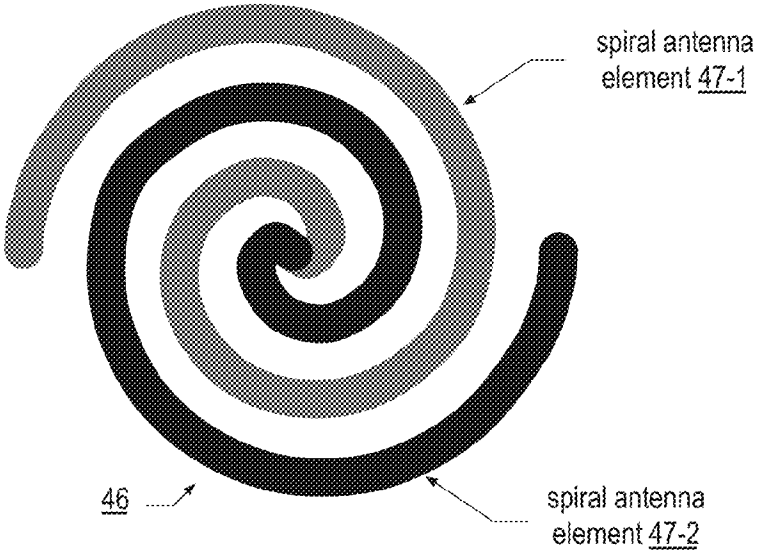
FIG. 12 is a diagram of an embodiment of interwoven spiral antenna elements in accordance with the present invention.

FIG. 12 is a diagram of an embodiment of a spiral antenna section 46 including interwoven spiral antenna elements 47-1 and 47-2. Each of the spiral antenna elements 47-1 and 47-2 may have an Archimedean spiral shape or an equiangular spiral shape. Further, each of the spiral antenna elements may have a symmetric spiral pattern or an eccentric spiral pattern. Still further, each of the spiral antenna elements may include a conductive wire formed as a multiple turn spiral.

Due to the spiral nature of the interwoven spiral antenna elements 47-1 and 47-2, the antenna section 46 has a gain of approximately 3 dB (e.g., a spiral gain component) as a result of the opposite radiation lobe being inverted, thus doubling the forward radiation pattern energy. The gain of the antenna 12 is further increased by approximately 2 dB due the three-dimensional shape of the antenna sections (e.g., a three-dimensional gain component). As such, the 3D multiple spiral antenna 12 has approximately a 5 dB gain and combined power from each of the spiral antenna sections 46.

The frequency band of operation of the 3D multiple spiral antenna 12 is based, at least in part, on the physical attributes of the antenna sections 46. For instance, the dimensions of the excitation region of each of the spiral antenna sections 46 (i.e., the feed point and/or the radius of the inner turn) establish an upper cutoff region of the bandwidth and the circumference of each of the spiral antenna sections 46 establishes a lower cutoff region of the bandwidth. The interwoven spiral pattern creates a circular polarization. The trace width, distance between traces, length of each spiral section, distance to a ground plane, and/or use of an artificial magnetic conductor plane affect the quality factor, radiation pattern, impedance (which is fairly constant over the bandwidth), gain, and/or other characteristics of the antenna 12.

In a specific example, a 20 mm radius (e.g., $2*\pi*20=125.66$ mm circumference) of a spiral antenna section 46 provides a low frequency cutoff of approximately 2 GHz and an excitation region with a radius of approximately 5 mm establishes a high frequency cutoff of approximately 8 GHz. As such, this specific example antenna 12 has a bandwidth of 2-8 GHz, centered at 5 GHz with the combined power for the spiral antenna sections 46.

Figure 13:
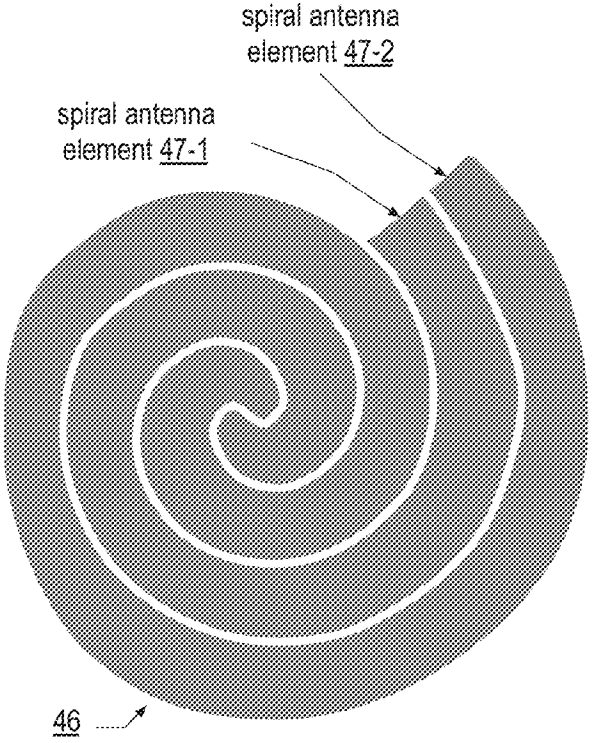
FIG. 13 is a diagram of another embodiment of interwoven spiral antenna elements in accordance with the present invention.

FIG. 13 is a diagram of another embodiment of a spiral antenna section 46 including a first spiral antenna element 47-1 interwoven with a second spiral antenna element 47-2. Each of the first and second spiral antenna elements 47-1 and 47-2 may have an Archimedean spiral shape or an equiangular spiral shape. Further, each of the first and second spiral antenna elements may have a symmetric spiral pattern or an eccentric spiral pattern. Still further, the interwoven spiral antenna elements 47-1 and 47-2 may be a substantially solid conducive material, wherein a multiple turn spiral slot separates the first and second spiral antenna elements 47-1 and 47-2.

FIG. 14 is a diagram of an embodiment of a 3D multiple spiral antenna 12 that includes three spiral antenna sections 46 and the feed point module 48. Each of the spiral antenna sections 46 includes a first spiral antenna element 47-1 interwoven with a second spiral antenna element 47-2. The feed point module 48 includes transmission line (TL) connections 48-2 and a common excitation point 48-1 (e.g., a common coupling circuit). The transmission line connections 48-1 connect the individual feed points of the spiral antenna sections 46 to the common excitation point 48-1.

In an example of transmitting an outbound RF signal, the outbound RF signal is provided to the common excitation point 48-1. Each of the transmissions lines 48-2, which have substantially identical transmission line properties, provides the outbound RF signal to the individual feed points of the spiral antenna sections 46 for concurrent in-phase transmission of the outbound RF signal 30. In an embodiment, a feed point of a spiral antenna section 46 is at a centered connection of the first and section spiral antenna elements. Note that the arrows indicate the direction of current flow.

In an example of receiving an inbound RF signal, the inbound RF signal is received by each of the spiral antenna sections 46. The spiral antenna sections 46 provide the inbound RF signal 32 to the common excitation point 48-1 via their respective feed points and their respective transmission line connection 48-2.

FIG. 15 is a diagram of another embodiment of a 3D multiple spiral antenna 12 that includes three spiral antenna sections 46 and the feed point module 48. Each of the spiral antenna sections 46 includes a first spiral antenna element 47-1 interwoven with a second spiral antenna element 47-2. The feed point module 48 includes a phase generator 48-3 and connection traces 48-4. The phase generator 48-3 includes multiple excitation points (three in this example, 48-0, 48-120 and 48-240) that are coupled to the individual feed points of the spiral antenna sections 46. The connection traces 48-4 couple the ends of the spiral antenna sections 46 together.

In an example of transmitting an outbound RF signal, the outbound RF signal is provided to the phase generator 48-3, which creates three phase-shifted representations thereof (0 degree, 120 degree, and 240 degree). The 0 degree phase shifted representation of the outbound RF signal is provided to the spiral antenna section 46 coupled to the 0 degree excitation point 48-0; the 120 degree phase shifted representation of the outbound RF signal is provided to the spiral antenna section 46 coupled to the 120 degree excitation point 48-120; and the 240 degree phase shifted representation of the outbound RF signal is provided to the spiral antenna section 46 coupled to the 240 degree excitation point 48-240.

Each of the spiral antenna sections 46 transmits it respective phase-shifted representation of the outbound RF signals. With the ends of the spiral antenna sections 46 coupled together, the spiral antenna sections 46 provide a multiple sinusoidal cycle standing wave output (i.e., the voltage and current at the ends points are not constant (e.g., zero current and non-zero voltage) and, collectively, the spiral antenna sections 46 produce standing current and standing voltage sinusoidal signals over 720 degrees). With the length of the connection traces corresponding to the phase shift (e.g., 120 degrees for three phase shifted representations), the current and voltage at the end of one spiral antenna section are at the same phase of a sinusoidal signal as the current and voltage at the end of one of the other spiral sections 46.

In an example of receiving an inbound RF signal, each of the spiral antenna sections 46 receives a phase shifted representation of the inbound RF signal. The spiral antenna sections 46 provide the inbound RF signal to their respective excitation points 48-0, 48-120 and 48-240 of the phase generator 48-3 via their respective feed points. The phase generator 48-3 combines the phase shifted representations of the inbound RF signal to produce the inbound RF signal.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

As may also be used herein, the terms "processing module", "processing circuit", and/or "processing unit" may be a single processing device or a plurality of processing devices. Such a processing device may be a microprocessor, microcontroller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The processing module, module, processing circuit, and/or processing unit may be, or further include, memory and/or an integrated memory element, which may be a single memory device, a plurality of memory devices, and/or embedded circuitry of another processing module, module, processing circuit, and/or processing unit. Such a memory device may be a read-only memory, random access memory, volatile memory, non-volatile memory, static memory, dynamic memory, flash memory, cache memory, and/or any device that stores digital information. Note that if the processing module, module, processing circuit, and/or processing unit includes more than one processing device, the processing devices may be centrally located (e.g., directly coupled together via a wired and/or wireless bus structure) or may be distributedly located (e.g., cloud computing via indirect coupling via a local area network and/or a wide area network). Further note that if the processing module, module, processing circuit, and/or processing unit implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that, the memory element may store, and the processing module, module, processing circuit, and/or processing unit executes, hard coded and/or operational instructions corresponding to at least some of the steps and/or functions illustrated in one or more of the Figures. Such a memory device or memory element can be included in an article of manufacture.

The present invention has been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

Unless specifically stated to the contra, signals to, from, and/or between elements in a figure of any of the figures presented herein may be analog or digital, continuous time or discrete time, and single-ended or differential. For instance, if a signal path is shown as a single-ended path, it also represents a differential signal path. Similarly, if a signal path is shown as a differential path, it also represents a single-ended signal path. While one or more particular architectures are described herein, other architectures can likewise be implemented that use one or more data buses not expressly shown, direct connectivity between elements, and/or indirect coupling between other elements as recognized by one of average skill in the art.

The term "module" is used in the description of the various embodiments of the present invention. A module includes a processing module, a functional block, hardware, and/or software stored on memory for performing one or more functions as may be described herein. Note that, if the module is implemented via hardware, the hardware may operate independently and/or in conjunction software and/or firmware. As used herein, a module may contain one or more sub-modules, each of which may be one or more modules.

While particular combinations of various functions and features of the present invention have been expressly described herein, other combinations of these features and functions are likewise possible. The present invention is not limited by the particular examples disclosed herein and expressly incorporates these other combinations.

What is claimed is:

1. A three-dimensional multiple spiral antenna comprising:

a substrate having a plurality of substantially planar layers and a three-dimensional shaped region formed thereon;

a plurality of circuit components residing upon at least two differing substantially planar layers of the plurality of substantially planar layers;

a plurality of spiral antenna sections, wherein each spiral antenna section of the plurality of spiral antenna sections is supported by a corresponding section of the three-dimensional shaped region and conforms to the corresponding section of the three-dimensional shaped region such that, collectively, the plurality of spiral antenna sections has an overall shape approximating the three-dimensional shaped region;

a feed point module; and a common coupling circuit that couples connection points of the plurality of spiral antenna sections to the feed point module.

2. The three-dimensional multiple spiral antenna of claim 1, wherein the plurality of spiral antenna sections comprise at least three spiral antenna sections.

3. The three-dimensional multiple spiral antenna of claim 2, wherein the plurality of spiral antenna sections are radial spaced apart about the feed point module.

4. The three-dimensional multiple spiral antenna of claim 1, wherein the feed point module is supported by and conforms to the three-dimensional shaped region.

5. The three-dimensional multiple spiral antenna of claim 1, wherein:

the three-dimensional shaped region comprises a non-conductive region formed upon the substrate; and the plurality of spiral antenna sections comprise conductors formed upon the non-conductive region.

6. The three-dimensional multiple spiral antenna of claim 5, wherein the non-conductive region comprises:

a hyperbolic shaped region;

a conical shaped region a cup shaped region;

a cylindrical shaped region;

a pyramid shaped region;

a box shaped region;

a hemispherical shaped region; or a parabolic shaped region.

7. The three-dimensional multiple spiral antenna of claim 1, wherein a spiral antenna section of the plurality of spiral antenna section comprises:

a spiral antenna element having an Archimedean symmetric spiral shape;

a spiral antenna element having an Archimedean eccentric spiral shape;

a spiral antenna element having an equiangular symmetric spiral shape; or a spiral antenna element having an equiangular eccentric spiral shape.

8. The three-dimensional multiple spiral antenna of claim 1, wherein a higher end of a frequency band of the three-dimensional multiple spiral antenna is based on an inner radius of the common coupling circuit.

9. The three-dimensional multiple spiral antenna of claim 1, wherein a higher end of a frequency band of the three-dimensional multiple spiral antenna is based on an inner radius of the common coupling circuit.

10. A three-dimensional multiple spiral antenna comprising:

a substrate having a plurality of substantially planar layers and a three-dimensional shaped region formed therein;

a plurality of spiral antenna sections, wherein each spiral antenna section of the plurality of spiral antenna sections is supported by a corresponding section of the three-dimensional shaped region and conforms to the corresponding section of the three-dimensional shaped region such that, collectively, the plurality of spiral antenna sections has an overall shape approximating the three-dimensional shaped region;

a feed point module supported by the three-dimensional shaped region; and a common coupling circuit that couples connection points of the plurality of spiral antenna sections to the feed point module.

11. The three-dimensional multiple spiral antenna of claim 10, wherein the plurality of spiral antenna sections comprise at least three spiral antenna sections.

12. The three-dimensional multiple spiral antenna of claim 11, wherein the plurality of spiral antenna sections are radial spaced apart about the feed point module.

13. The three-dimensional multiple spiral antenna of claim 10, further comprising a plurality of circuit components residing upon at least two differing substantially planar layers of the plurality of substantially planar layers.

14. The three-dimensional multiple spiral antenna of claim 10, wherein the feed point module is supported by and conforms to the three-dimensional shaped region.

15. The three-dimensional multiple spiral antenna of claim 14, wherein the three-dimensional shaped region comprises:

a conical shaped region a cup shaped region;

a pyramid shaped region;

a box shaped region;

a hemispherical shaped region;

a cylindrical shaped region; or a parabolic shaped region.

16. The three-dimensional multiple spiral antenna of claim 10, wherein a spiral antenna section of the plurality of spiral antenna section comprises:

a spiral antenna element having an Archimedean symmetric spiral shape;

a spiral antenna element having an Archimedean eccentric spiral shape;

a spiral antenna element having an equiangular symmetric spiral shape; or a spiral antenna element having an equiangular eccentric spiral shape.

17. A three-dimensional multiple spiral antenna comprising:

a substrate having a plurality of substantially planar layers and a three-dimensional shaped region formed thereon;

a plurality of spiral antenna sections, wherein each spiral antenna section of the plurality of spiral antenna sections is supported by a corresponding section of the three-dimensional shaped region and conforms to the corresponding section of the three-dimensional shaped region such that, collectively, the plurality of spiral antenna sections has an overall shape approximating the three-dimensional shaped region;

a feed point module; and a common coupling circuit that couples connection points of the plurality of spiral antenna sections to the feed point module.

18. The three-dimensional multiple spiral antenna of claim 17, wherein the plurality of spiral antenna sections comprise at least three spiral antenna sections that are radial spaced apart about the feed point module.

19. The three-dimensional multiple spiral antenna of claim 17, wherein:

the three-dimensional shaped region comprises a non-conductive region formed upon the substrate;

the plurality of spiral antenna sections comprise conductors formed upon the non-conductive region; and the feed point module is formed upon the non-conductive region.

20. The three-dimensional multiple spiral antenna of claim 17, further comprising a plurality of circuit components residing upon at least two differing substantially planar layers of the plurality of substantially planar layers.

* * * * *